United States Patent [19]

Osteen et al.

[11] Patent Number: 5,014,175

[45] Date of Patent: May 7, 1991

[54] LUMINAIRE HAVING A REFLECTOR CONTAINING ASYMMETRICAL RIDGES FOR DISTRIBUTING LIGHT OUTPUT ASYMMETRICALLY

[75] Inventors: Mitchell M. Osteen, Zirconia; Samuel L. Baldwin, E. Flat Rock, both of N.C.

[73] Assignee: General Electric Company, Schenectady, N.Y.

[21] Appl. No.: 422,467

[22] Filed: Oct. 17, 1989

Related U.S. Application Data

[63] Continuation-in-part of Ser. No. 378,348, Jul. 11, 1989, Pat. No. 4,943,901.

[51] Int. Cl.[5] ..... F21V 7/04

[52] U.S. Cl. ..... 362/348; 362/297; 362/350

[58] Field of Search ..... 362/296, 297, 341, 347, 362/348, 350

[56] References Cited

U.S. PATENT DOCUMENTS

| | | | |
|---|---|---|---|
| 1,851,916 | 3/1932 | MacDonald | 362/348 X |
| 3,662,165 | 5/1972 | Osteen et al. | 240/103 R |
| 4,303,971 | 12/1981 | Hogue et al. | 362/297 |
| 4,358,816 | 11/1982 | Soileau | 362/346 |
| 4,864,476 | 9/1984 | Lemons et al. | 362/348 |

FOREIGN PATENT DOCUMENTS

| | | | |
|---|---|---|---|
| 533135 | 11/1954 | Belgium | 362/348 |
| 493892 | 9/1950 | France | 362/348 |

OTHER PUBLICATIONS

American Society of Metals Handbook, Article Entitled "Spinning", pp. 201–208, vol. 4, published by American Society of Metals, Cleveland, Ohio in 1967. Drawing of reflector delivered by General Electric Co. to a purchaser prior to 1988.

*Primary Examiner*—Stephen F. Husar
*Assistant Examiner*—Peggy Neils
*Attorney, Agent, or Firm*—John P. McMahon; Stanley C. Corwin; Fred Jacob

[57] ABSTRACT

In this luminaire, there is a dome-shaped reflector having a top, a bottom, and a central axis on which a light source is adapted to be positioned. A metal wall of the reflector has an inner surface extending about the central axis and defining a bottom opening through which the inner surface reflects light received from the source. The angular distribution about the central axis of the light reflected from the inner surface through the bottom opening is controlled by many elongated facets on the inner surface extending in a top-to-bottom direction with respect to the reflector. The facets are arranged about the central axis in side-by-side relationship, with juxtaposed facets being at an angle with respect to each other so as to form alternating ridges and grooves between juxtaposed facets. The individual ridges, when viewed in transverse cross-section, each include two of the facets intersecting at an apex that is located on a reference line for each ridge extending radially outward from said central axis. The individual ridges that are located in predetermined sectors of the inner surface each have one of its two facets disposed at a much smaller angle with respect to its reference line than the other of the two facets so that this ridge is highly bilaterally asymmetrical with respect to said reference line.

6 Claims, 5 Drawing Sheets

LUMINAIRE HAVING A REFLECTOR CONTAINING ASYMMETRICAL RIDGES FOR DISTRIBUTING LIGHT OUTPUT ASYMMETRICALLY

CROSS REFERENCE TO RELATED APPLICATION

This application is a continuation-in-part of our copending application Ser. No. 378,348 filed July 11, 1989, now U.S. Pat. No. 4,943,901 which is incorporated by reference in the present application.

BACKGROUND

This invention relates to a luminaire and, more particularly, to a luminaire comprising a reflector which, though having a generally symmetrical configuration with respect to its central axis, is capable of producing a photometric distribution of its light output that is asymmetrical with respect to said central axis.

A very cost-effective method for making the reflector of a luminaire is a spinning process in which a disk-shaped blank of metal is spun into a hollow form suitable for the final configuration of the reflector. In a typical spinning process, a mandrel having an external shape corresponding to the internal shape of the reflector being formed is rotated about a central axis while the disk-shaped metal blank, fixed to the mandrel and rotating therewith, is deformed about the mandrel by localized force applied to the blank through a stationary spinning tool. For a more detailed description of such a spinning process, reference may be had to the section on spinning in the American Society of Metals Handbook, published in 1967 by the American Society of Metals, Cleveland, Ohio, pages 201-208, Volume 4.

This spinning process readily lends itself to the manufacture of reflectors that are symmetrical with respect to a central axis since the mandrel and the disk-shaped blank being formed are usually rotated about such axis during spinning. A reflector that is symmetrical about a central axis will ordinarily provide a symmetrical photometric distribution of its light output, assuming the light source of the luminaire is located on the central axis of the reflector. In many lighting applications, however, a photometric distribution that is asymmetrical with respect to the central axis is desired. A lighting application of this type is disclosed in U.S. Pat. No. 4,303,971 - Hogue et al, assigned to the assignee of the present invention, where the disclosed luminaire is used for illuminating stacked material along a warehouse aisle. This luminaire directs most of its light output from the reflector along the length of this aisle, developing four light beams that emanate from the reflector in an elongated X-shaped pattern, as seen in FIGS. 4 and 5 of the patent.

In order to develop this radially asymmetrical light pattern, Hogue is required to rely upon a reflector that is asymmetrical with respect to its central axis. More specifically, his reflector comprises four reflector portions that together surround the central axis of the reflector and are each of an elliptical form when viewed in horizontal cross-sectional planes taken through the reflector. This is a rather complicated configuration, use of which requires that the reflector be formed by some process other than the relatively simple and inexpensive spinning process referred to above. In actual practice, a two-step hydroforming process is relied upon.

OBJECTS

An object of the present invention is to provide, for a luminaire, a reflector that is generally symmetrical with respect to a central axis of the reflector and yet is capable of producing a photometric distribution of asymmetric form with respect to said central axis.

Another object is to provide a reflector that is generally symmetrical with respect to its central axis and yet is capable of producing a photometric distribution for its light output of a configuration approximation that illustrated in the Hogue et al patent referred to above.

Another object is to provide a reflector capable of meeting one or both of the above objects and which readily lends itself to being manufactured by a simple and inexpensive spinning process.

SUMMARY

In carrying out the invention in one form, we provide a generally dome-shaped reflector having a top, a bottom, and a central axis on which a light source is adapted to be positioned. The reflector is formed by a metal wall having an inner surface extending about the central axis and defining a bottom opening through which the inner surface reflects light received from the source. The angular distribution about the central axis of the light reflected from the inner surface through the bottom opening is controlled by means comprising a plurality of elongated facets on the inner surface extending in a top-to-bottom direction with respect to the reflector. The facets are arranged about the central axis in side-by-side relationship, with juxtaposed facets being at an angle with respect to each other so as to form alternating ridges and grooves between juxtaposed facets. The individual ridges, when viewed in transverse cross-section, each include two of the facets intersecting at an apex that is located on a reference line for each ridge extending radially outward from said central axis. The individual ridges that are located in predetermined sectors of the inner surface each have one of its two facets disposed at a much smaller angle with respect to its reference line than the other of the two facets so that this ridge is highly bilaterally asymmetrical with respect to said reference line.

BRIEF DESCRIPTION OF FIGURES

For a better understanding of the invention, reference may be had to the following detailed description taken in con]unction with the accompanying drawings, wherein.

DETAILED DESCRIPTION OF EMBODIMENT

Figure 1:
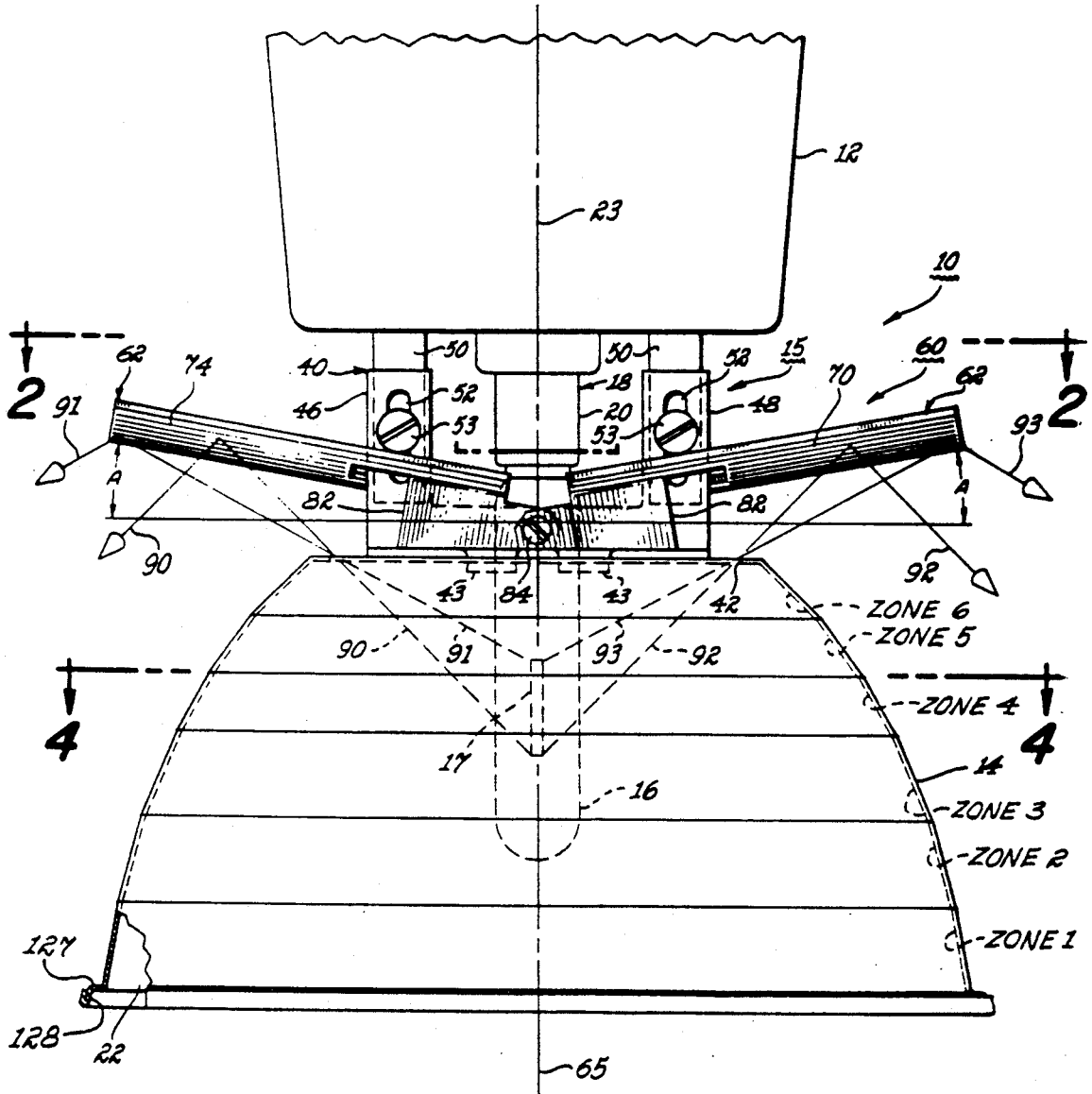
FIG. 1 is a side elevational view of a luminaire comprising a main reflector and auxiliary reflectors and embodying one form of the invention.

The luminaire that is shown in the drawings of the present application is one which is disclosed in our aforesaid copending patent application Ser. No. 378,348. The present application employs the same reference numerals as the prior application to designate corresponding parts.

GENERAL ASPECTS OF THE LUMINAIRE 10

Referring now to FIG. 1, there is shown a luminaire 10 of a type that is adapted to he mounted over a warehouse aisle or the like for illuminating material stacked along the edges of the aisle. The luminaire comprises a conventional ballast housing schematically illustrated at 12 suitably suspended from ceiling structure (not shown) and containing the usual ballast components. From the bottom of the ballast housing, there is suspended a generally dome-shaped main reflector 14, typically of aluminum sheet. Adjustable support structure 15 (soon to be described in more detail) is relied upon for suspending the reflector from the ballast housing.

Mounted within the main reflector 14 is a lamp 16, which is typically a high intensity gaseous discharge lamp such as a sodium vapor, mercury vapor, or metal halide lamp. The arc tube of the lamp is schematically shown at 17. This lamp 16 is supported within a socket 18 that comprises a tubular housing 20 of electrical insulating material mounted on the bottom wall of the ballast housing 12. The lamp 16 is suitably electrically connected through the socket to the ballast components in housing 12 for operation thereby.

Figure 4:
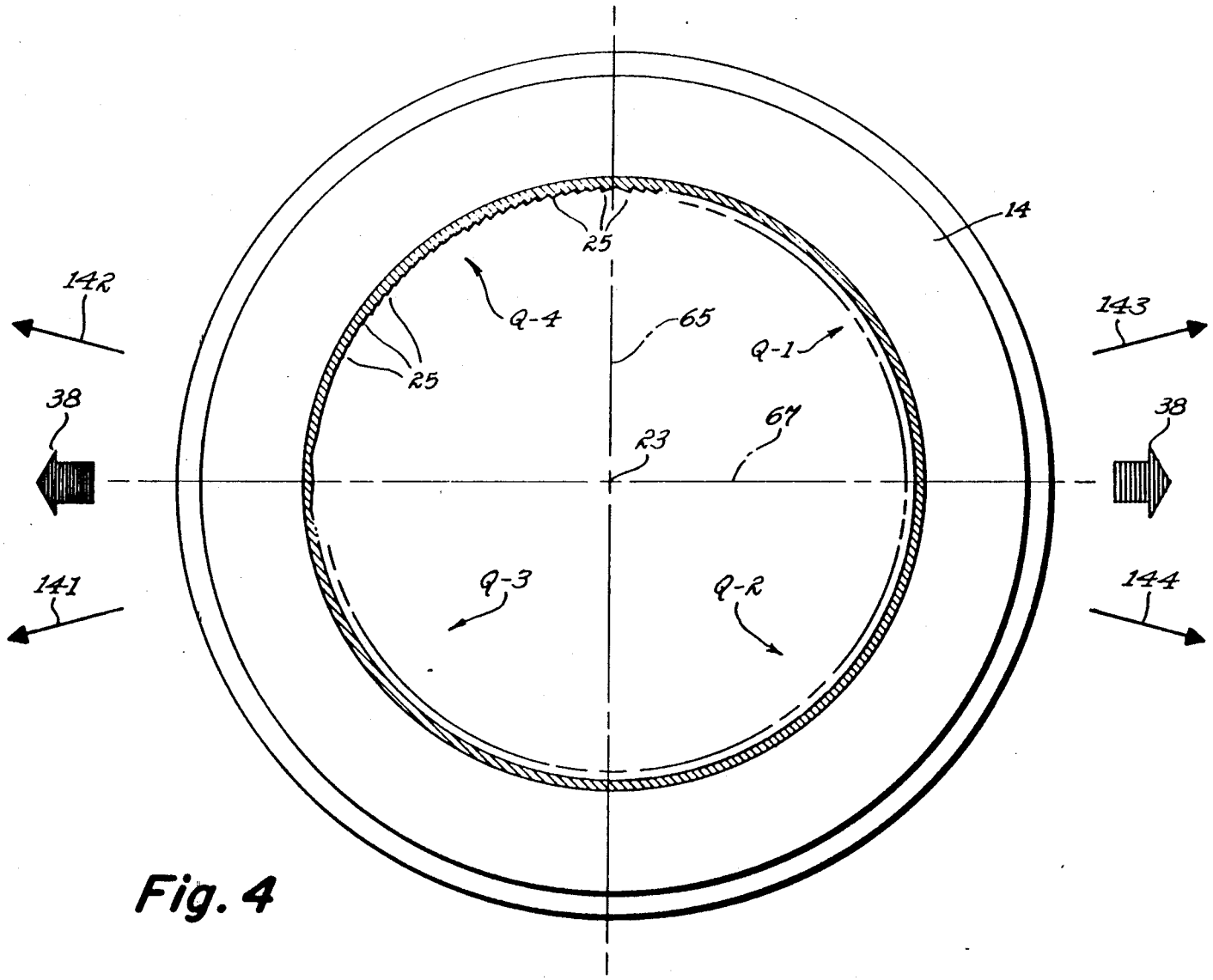
FIG. 4 is a simplified sectional view along the line 4—4 of FIG. 1.

The luminaire is normally mounted above the floor of the warehouse aisle midway between the edges of the aisle, with the bottom opening 22 of the main reflector 14 facing downwardly and lamp 16 extending along the central vertical axis 23 of the main reflector. Light from the lamp 16 is reflected off the internal surface of the dome-shaped main reflector 14, passing downwardly and outwardly through the bottom opening 22. The reflector 14 is provided on its internal surface with facets, some of which are shown at 25 in FIG. 4, which are located and shaped to receive light from the lamp and to reflect such light through bottom opening 22 along the length of the aisle and onto the stacks at the edges of the aisle. More details of the facets 25 and their method of construction are set forth hereinafter. The reflected light emerging through the bottom opening 22 has a distribution similar to that illustrated in FIGS. 4 and 5 of t he aforesaid Hogue et al U.S. Pat. No. 4,303,971, where it can be seen that a major portion of the reflected light illuminates the lower portions of the stacks at locations spaced along the aisle from the luminaire. Where a plurality of such luminaires are provided at spaced locations along the length of the aisle, the luminaires are usually relied upon to direct most of the reflected light onto areas approximately midway between the luminaires. Direct light from the lamp illuminates the areas of the aisle and the stacks that are located beneath the luminaire in proximity thereto. Referring to the illustrated luminaire, the aisle length runs in the direction of arrows 38 of FIGS. 2 and 4.

Figure 3:
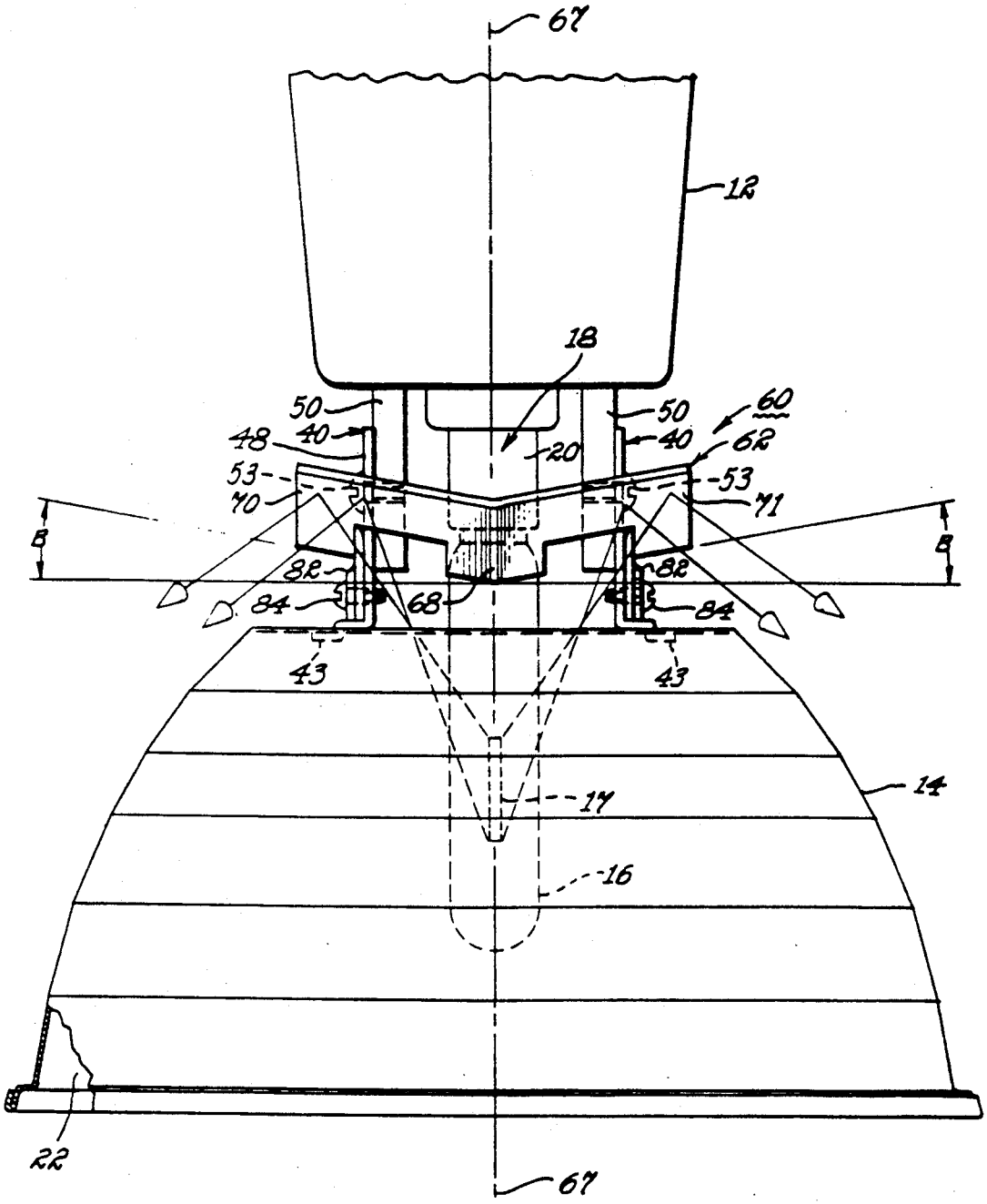
FIG. 3 is a front view of the luminaire of FIG. 1 as viewed from one side of FIG. 1.

The support means 15 for the main reflector 14 is adjustable to control the photometric distribution of the light along the aisle. By lowering the main reflector 14 with respect to the lamp 16, the extent of the photometric distribution along the aisle is decreased, and by raising the main reflector with respect to the lamp, this extent is increased. To enable such adjustments to be made, the main reflector is provided with two vertically-extending brackets 40 that are respectively positioned adjacent opposite edges of an elongated opening 42 in the top of the main reflector 14. These brackets 40 are fixed to the main reflector 14 by suitable means, such as feet 43 on the brackets extending into mating slots in the top of the main reflector, as shown in FIG. 3. Each of these brackets 40, as viewed in FIG. 1, is of U-shaped form and comprises vertically-extending legs 46 and 48 that are positioned adjacent vertically extending posts 50 that project downwardly from and are fixed to the bottom of the ballast housing 12. The legs 46 and 48 of the brackets contain slots 52 through which extend screws 53 that are received in mating threaded holes in the posts 50. When the screws 53 are loosened, the slotted brackets 40 can be slid up or down along posts 50, raising or lowering the reflector 14. When the desired position is obtained, the screws 53 are tightened to lock the brackets and the reflector in this position.

Figure 2:
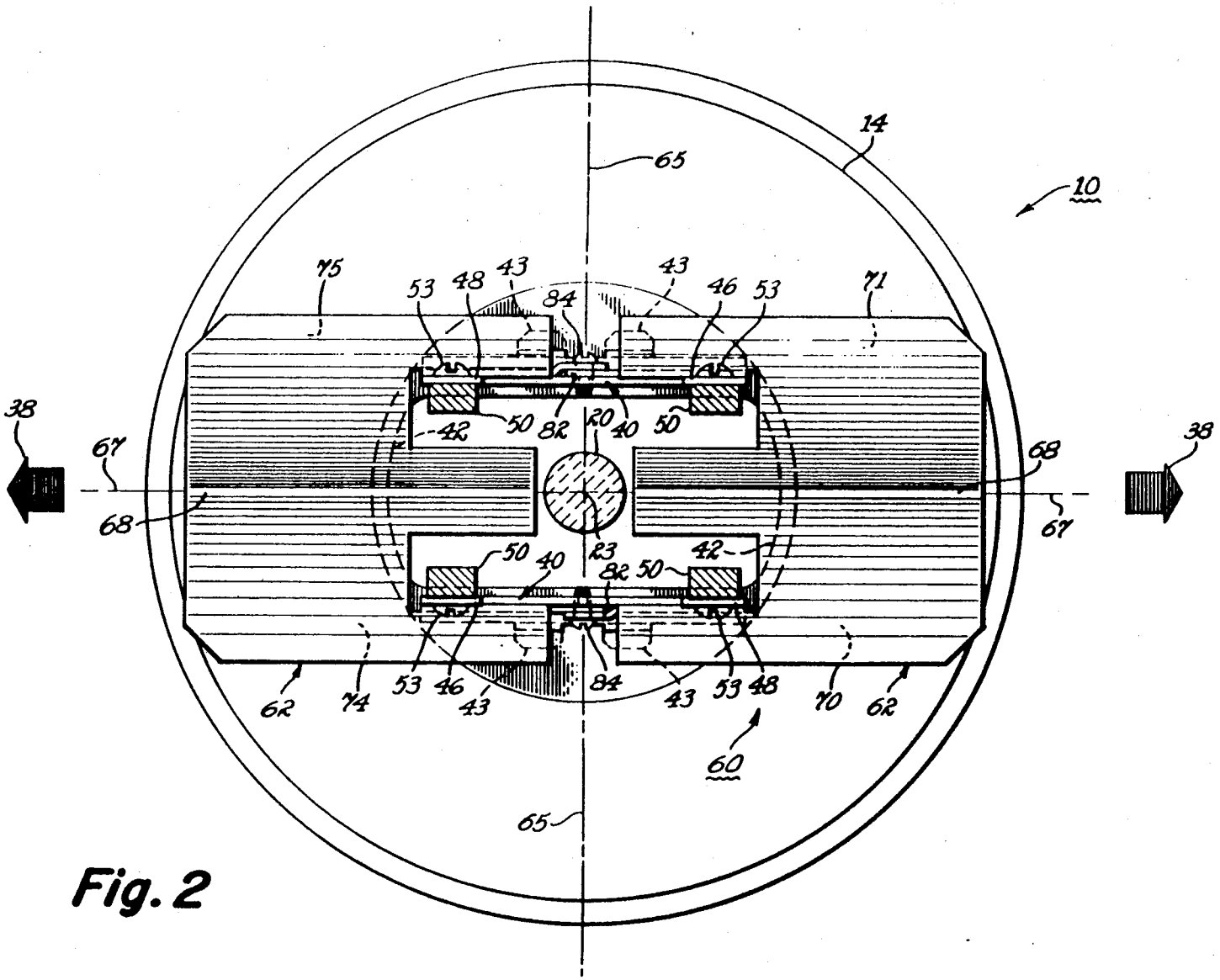
FIG. 2 is a sectional view along the line 2—2 of FIG. 1.

As pointed out in our above-referenced prior application Ser. No. 378,348, a problem that is present with conventional aisle-lighting luminaires that provide the above-described pattern of light distribution is that the upper areas of the stacks at the edges of the aisle are left relatively dark and difficult to see. As disclosed in our prior application, for overcoming this problem, we have provided our luminaire with auxiliary reflector means 60 located above the opening 42 in the top of the main reflector 14. This opening 4Z is best seen in FIG. 2, where it is shown in dotted-line form as an elongated opening, having its longer dimension extending along the length of the aisle. Although the auxiliary reflector means (60) is separate from the main reflector 14, it is disclosed herein since it is a part of the illustrated luminaire and is related to the claimed features. A general description of the auxiliary reflector means follows. More details appear in our aforesaid prior application.

AUXILIARY REFLECTOR MEANS 60

The auxiliary reflector means 60 comprises two plate members 62, each extending along the length of the aisle from a central vertical reference plane 65 (FIG. 2) that includes the central vertical axis 23 of the main reflector 14. Each of the plate members 62 is creased where it intersects a second vertical reference plane 67 that is normal to the first reference plane 65 and extends through the central axis of the reflector, running along the aisle length. The crease 68 divides each plate member into two reflective segments, thus providing a total of four such reflective segments 70, 71, 74, 75 above the top opening 42 for dividing the light emerging through top opening 42 into four beams. The reflective segments are oriented to direct this light to the sides of the aisle high on the stacks located therealong, i.e., into areas poorly illuminated by light passing through the bottom opening 22 of the main reflector. To provide this orientation, each of the reflective plate members 62 (and, hence, each of the reflective segments) in extending from reference plane 65 outwardly, is angled upward at an angle A from the horizontal, as seen in FIG. 1. In addition, each of the reflective segments 70, 71, 74, 75, in extending away from the crease 68 (or away from the second reference plane 67) is angled upward at an angle B, as seen in FIG. 3. Typical values for angles A and B are 10 degrees for each.

Because the light used by the auxiliary reflector means 60 is light exiting through the top of the main reflector, it is easier to direct toward the normally difficult-to-light areas of the stacks than would be the case with light emerging through the bottom opening 22. A major factor contributing to this ease is the higher elevation of the auxiliary reflectors. In addition, because the area of the main reflector dedicated to the top opening 42 would otherwise be directing light to an area directly below the main reflector, where usually there is already more than sufficient light, the presence of the top opening does not objectionably interfere with illumination in this nadir region. Moreover, the remaining portions of the main reflector, dedicated to controlling the main beams, remain intact and are still able to perform their intended functions.

With reflective segments oriented as illustrated, i.e., angled upwardly at about 10 degrees above horizontal in both side-to-side and end-to-end directions, light is directed outwardly along the aisle at 60 to 90 degrees above nadir and outwardly from the center of the aisle at 25 to 75 degrees above nadir. FIG. 1 shows light rays 90, 91, 92 and 93 emitted from the ends of the lamp arc tube 17, passing though the top opening 42 at an extremity of the opening, and reflected off of one of the reflective segments in a direction along the aisle length. Similar rays are shown in FIG. 3 being reflected off the reflective segments in a direction transversely of the aisle.

FORMING THE MAIN REFLECTOR 14 BY SPINNING

Figure 5:
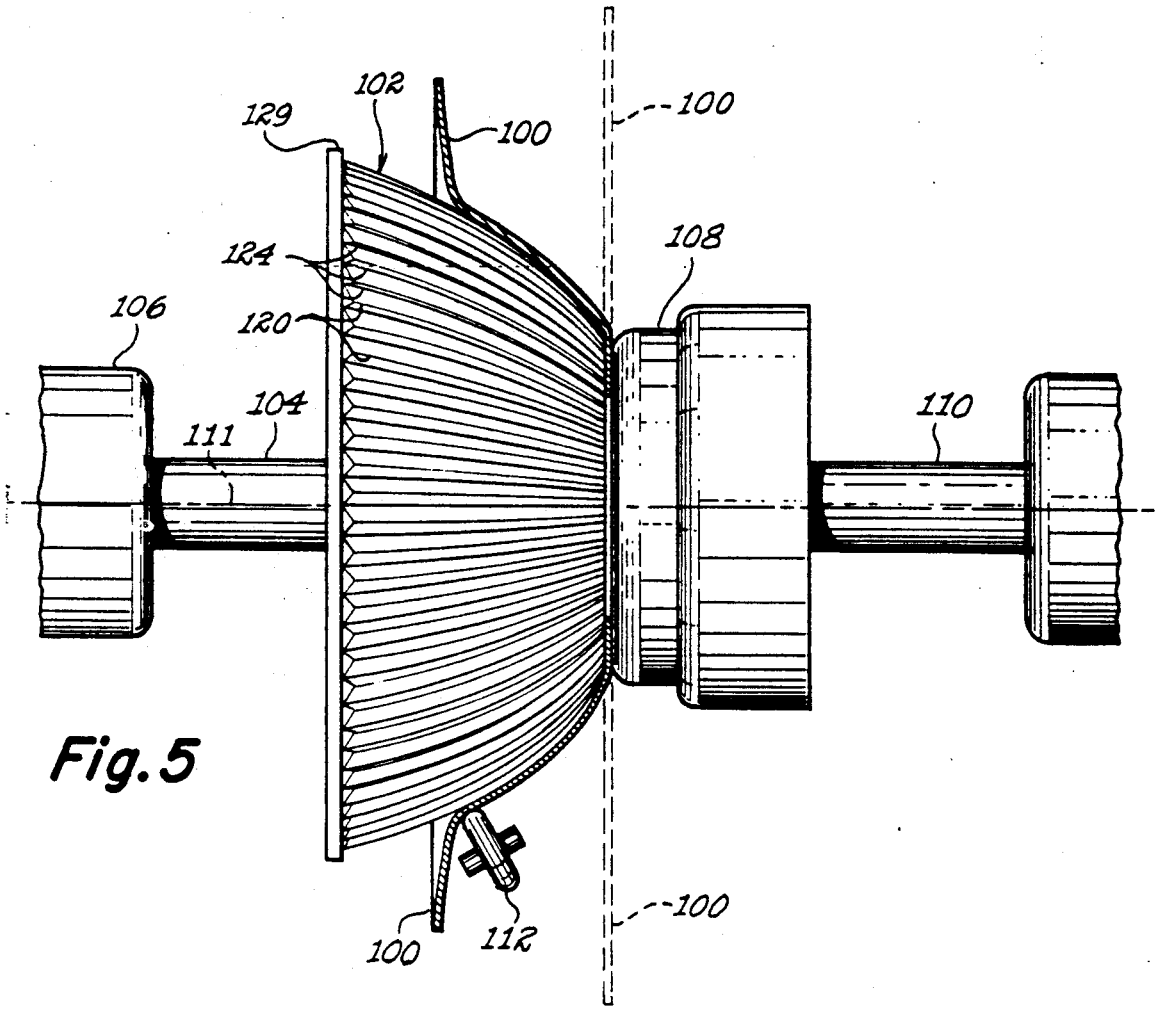
FIG. 5 is a schematic showing of a spinning process used for making the main reflector of the luminaire of FIGS. 1-4. The main reflector and the mandrel on which it is formed is shown in full but in simplified form.

The main reflector 14 is a dome-shaped member, which is formed from a circular disk-shaped blank of aluminum by a metal spinning process. One way of carrying out this spinning process is illustrated in FIG. 5, where the circular blank 100 of aluminum in its initial disk-shaped form is shown in dotted lines. A mandrel 102 having an external configuration corresponding to the desired configuration of the internal surfaces of the reflector is fixed to a spindle 104 that is rotationally driven by the headstock 106 of the lathe. A follower block 108 mounted on a tailstock 110 of the lathe clamps the blank 100 to the flat central portion of the mandrel and rotates with the mandrel when the mandrel is driven. During the spinning process, all the rotatable parts 100, 102, 104, and 108 rotate about a single axis of rotation 111. Although this axis 111 is shown in FIG. 5 as being horizontal, it can equally well be vertically disposed.

While the disk-shaped blank 100 is being rotated by the mandrel 102, a roller-type spinning tool 112 of appropriate external contour is forced against the right-hand surface of the blank at locations spaced from the axis of rotation, thereby deforming the blank over the mandrel. During the spinning process, the angular location of the spinning tool 112 with respect to the axis of rotation 111 preferably remains stationary, but the spinning tool is driven to the left along the axis 111 while at the same time being urged with appropriate force toward the underlying external periphery of the rotating mandrel. FIG. 5 shows the spinning operation at an intermediate stage where the tool 112 has moved through a portion of its stroke and has partially deformed the blank. It is to be understood that, in accordance with conventional practice, a suitable lubricant is present between the blank and the spinning tool to facilitate the spinning operation.

As pointed out hereinabove, it is desired that the internal surface of the reflector wall 114 have alternating ridges and grooves therein that extend in a top-to-bottom direction in the reflector of FIG. 1. These ridges and grooves are introduced as a part of the spinning operation. More specifically, the mandrel 102 has on its external surface grooves 120 corresponding in configuration to the ridges 122 desired on the internal surface of the reflector wall and ridges 124 corresponding to the grooves 125 desired on this internal surface. When the spinning tool is driven along its above-described path, the metal adjacent the inner surface of the reflector wall is deformed by the localized force applied by the spinning tool and forced to conform quite precisely, in mirror image, with the grooves and ridges on the mandrel. As will soon be described in more detail, these ridges and grooves in the reflector are quite shallow, e.g., only about one-half the thickness of the initial aluminum sheet 100 that is used for forming the reflector wall; and this facilitates their formation as part of the spinning process. Metal adjacent the inner surface of the reflector is, in effect, extruded into the grooves 120 in the mandrel. The external surface of the formed reflector is free of these ridges and grooves, remaining quite smooth except for the slight circumferentially-extending tool marks that typically accompany this type of spinning process.

At the lower end of the main reflector 14, as seen in FIG. 1, there is a narrow horizontally-extending flange 127 and a short vertically-extending lip 128 with a rolled-over edge. These portions of the reflector are incorporated during the spinning process in a conventional manner by spinning the outer peripheral region of the metal blank 100 over a flange 129 at the left-hand end of the mandrel 102 (FIG. 5) and then spinning the extreme outer peripheral edge of the blank back onto itself to form the rolled-over edge.

DETAILS OF THE MAIN REFLECTOR 14

The dome-shaped main reflector 14 that is illustrated in FIG. 1 may be thought of as comprising a series of superimposed integrally-connected sections, each of a truncated conical form and each merging smoothly with the smaller diameter section immediately above it. Each truncated conical section tapers to a progressively greater extent than the one beneath it. The truncated conical sections are respectively located in superposed regions of the dome designated Zones 1 through 6 in FIG. 1.

In one specific embodiment of the invention, the reflector has a radius of 7.66 inches at its bottom opening and 4.01 at its top. Its length, as measured along its central axis 23 is 7.8 inches. The following table, which should be read in conjunction with FIG. 6, discloses how the ridges 122 on the inner surface of the reflector wall are shaped and located. Each of these ridges 122 has two facets 25 and 27 intersecting at an apex 28. The angle D referred to in the table is the angular distance between this apex 28 and the transverse reference plane 65 that (i) extends normal to the aisle over which the reflector is mounted and (ii) includes the central axis 23 of the reflector. Angle E in the angle between one facet 25 of the ridge and a reference line 132 extending radially outward from the central axis of the reflector through the apex 28. Angle F is the angle between the other facet 27 of the ridge and this radial reference line 132. The table describes the ridges 122 on the portion of the inner surface located in one 90 degree sector, or quadrant, of the circular reflector. The other three quadrants of the reflector have identical ridges. The quadrant described in the table may be thought of as a quadrant Q-4; the adjoining quadrant on the opposite side of reference plane 65 may be thought of as quadrant Q-1, and then proceeding clockwise, the next two quadrants (shown in FIG. 4) may be thought of as quadrants Q-2 and Q-3. Each quadrant has its ridges arranged in mirror-image fashion with respect to the ridges of its adjoining quadrant.

TABLE

| ZONE | ANG "D" | ANG "E" | ANG "F" |
|---|---|---|---|
| 1 | 1 to 30 | 70° | 20° |
| TO | 1° Steps | | |
| 4 | 31 to 54 | 80° | 10° |
| | 1° Steps | | |
| | 55 to 70 | 87° | 3° |
| | 1° Steps | | |
| | 71 to 80 | OMIT | OMIT |
| | 1° Steps | | |
| | 81 to 90 | 85° | 85° |
| | 2° Steps | | |
| 5 | 1 to 30 | 70° | 20° |
| TO | 1.25° Steps | | |
| 6 | 31 to 55 | 80° | 10° |
| | 1.25° Steps | | |
| | 56 to 70 | 87° | 3° |
| | 1.25° Steps | | |
| | 71 to 80 | OMIT | OMIT |
| | 1.25° Steps | | |
| | 81 to 90 | 85° | 85° |
| | 2.5° Steps | | |

Figure 6:
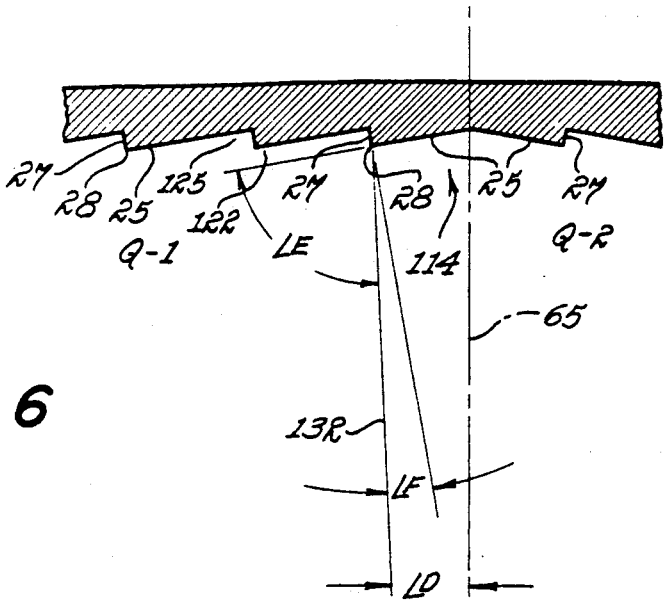
FIG. 6 is a greatly enlarged sectional view of a portion of the main reflector as seen in the same plane as the plane of FIG. 4.

To provide a specific example of how the table is to be read, reference may be had to the first horizontal line thereof. The second column in this first horizontal line indicates that in Zones 1 through 4 of the reflector, the apices of the ridges 122 are located at angularly-spaced intervals, or steps, of 1 degree in a 1 to 30 degree sector as measured by the angle D. The third and fourth columns respectively indicate that these particular ridges each have facets disposed at an angle E of 70 degrees, and an angle F of 20 degrees (FIG. 6).

The second horizontal line of the table shows the ridge parameters in a 31 to 54 degree sector of Zones 1–4.

It is noted that the fourth horizontal line of the table indicates that there are no ridges in the 71 to 80 degree sector of Zones 1 to 4.

Although the immediately-preceding several paragraphs make no reference to the grooves present in the inner surface, the two juxtaposed facets 25 and 27 of each pair of adjoining ridges 122 may be thought of as forming a groove 125. Accordingly, juxtaposed facets on the inner surface may be thought of as being arranged about the central axis 65 in side-by-side relationship and forming alternating ridges and grooves between adjacent facets.

It will be apparent from the table that for the ridges located in certain sectors of the reflector, the angle E is much greater than the angle F. This is the case, as indicated in the table, in those sectors extending for 70 degrees on either sides of the transverse reference plane 65. Because of this bilaterally asymmetrical configuration of the individual ridges, the light reflected from the ridges 122 through the bottom opening of the reflector has a photometric distribution which is asymmetrical with respect to the central axis of the reflector. Other factors contributing to this radial asymmetry of the light output are the fact that the ridges vary in configuration from one sector to another and the additional fact that they are entirely absent in certain sectors covering a restricted portion of the inner surface. By selecting appropriate values of these various parameters, an infinite variety of photometric distributions can be provided. The particular combination of parameters shown in the table gives a photometric distribution of the light output through the bottom opening of the reflector that approximates the elongated x-shaped light distribution that is shown in the aforesaid Hogue et al patent. In other words, four distinct beams of light are developed, with quadrants Q-1 and Q-2 of FIG. 4 developing beams that extend through the bottom opening generally in the direction of arrows 141 and 142, respectively, and quadrants Q-3 and Q-4 of FIG. 4 developing beams through the bottom opening generally in the direction of arrows 143 and 144, respectively.

It is especially significant that the reflector can produce a photometric distribution of asymmetrical form with respect its central axis even though its inner surface is basically a surface of revolution, i.e., a surface that, in general, is radially symmetrical about its central axis. As a result of this radial symmetry, the reflector can be made by a relatively simple and inexpensive spinning process, as has been described in connection with FIG. 5.

Although we have illustrated the invention as applied to a reflector comprising a series of sections each of truncated conical form (designated zones 1 through 6 in FIG. 1) and each tapering to a progressively greater extent than the section beneath it, it is to be understood that the invention is equally applicable to a reflector that is smoothly curved along its entire vertical extent, or to one which is in the form of a single truncated cone, or to other suitable surfaces of revolution which lend themselves to formation by spinning. In each of these configurations, shallow ridges, each asymmetric with respect to an associated radial reference line through its apex, is present While we have shown and described a particular embodiment of our invention, it will be obvious to those skilled in the art that various changes and modifications may be made without departing from our invention in its broader aspects; and we, therefore, intend herein to cover all such changes and modifications as fall within the true spirit and scope of our invention.

What is claimed is:

1. In a luminaire, a generally dome-shaped reflector having a top and bottom and, extending between said top and bottom, a central axis substantially on which a light source is adapted to be positioned between said top and bottom, said reflector being formed by a metal wall having an inner surface extending about said central axis and defining a bottom opening through which said inner surface reflects light received from said source, means for controlling the angular distribution of the light reflected by said inner surface through said bottom opening comprising a plurality of elongated facets on said inner surface extending in a top-to-bottom direction with respect to the reflector, the reflector being further characterized by:

(a) said facets being arranged about said axis in side-by-side relationship, with juxtaposed facets being at an angle with respect to each other so as to form alternating ridges and grooves between the juxtaposed facets, (b) the individual ridges when viewed in transverse crosssection, each including two of said facets intersecting at an apex that is located on a reference line for each ridge extending radially outward from said central axis, and (c) the individual ridges that are located in predetermined sectors of the inner surface each having one of its two facets disposed at a much smaller angle with respect to its said reference line than the other of said two facets so that such ridge is highly bilaterally asymmetrical with respect to said reference line, and in which:

(d) said metal wall, considered apart from all the ridges and grooves on the inner surface thereof, is substantially radially symmetrical with respect to said central axis, (e) said reflector is made by a spinning operation in which a blank constituted by a sheet of metal is spun into said dome-shaped form about a mandrel that has grooves therein conforming to the shape of said ridges on the inner surface of the reflector, the spinning operation rotating said blank and said mandrel about an axis of rotation substantially coinciding with said central axis, (f) said ridges are characterized by being of extruded metal forced into said mandrel grooves and by a height at their apices that is less than the thickness of the metal sheet constituting such blank.

2. Structure as defined in claim 1 for lighting the aisle of a warehouse or the like, in which:

(a) said reflector is adapted to be located directly over said aisle, and (b) said predetermined sectors containing said bilaterally asymmetric ridges are situated in sectors located adjacent a first reference plane that extends normal to said aisle and includes said central axis.

3. Structure as defined in claim 2 in which:

(a) certain of the alternating ridges and grooves on said inner surface are situated in predetermined sectors located adjacent a second reference plane that extends longitudinally of said aisle and includes said central axis, and (b) in said latter ridges the facets of individual ridges are disposed at approximately equal angles with respect to the associated reference line of the ridges, thus rendering each of said latter ridges generally symmetrical with respect to its associated reference line.

4. The structure of claim 1 in which said inner surface of said metal wall, as viewed in transverse cross-sectional planes normal to said central axis and located at substantially any level along most of the reflector's height, is substantially radially symmetrical with respect to said central axis, when considered apart from all the ridges and grooves therein.

5. The structure of claim 1 in which said metal wall, as viewed in transverse cross-sectional planes normal to said central axis and located at substantially any level along most of the reflector's height, is substantially circular, when considered apart from all the ridges and grooves therein.

6. Structure as defined in claim 3 in which said inner surface includes additional sectors located angularly between said predetermined sectors of (b), claim 2 and (a), claim 3, said additional sectors being substantially free of said ridges and grooves.

* * * * *